US005550552A

United States Patent [19]

Oxley

[11] Patent Number: 5,550,552

[45] Date of Patent: Aug. 27, 1996

[54] RADIATION SHIELD

[75] Inventor: L. Thomas Oxley, 2525 Hoffman La., Riverwoods, Ill. 60015

[73] Assignee: L. Thomas Oxley, Riverwoods, Ill.

[21] Appl. No.: 131,152

[22] Filed: Oct. 4, 1993

Related U.S. Application Data

[63] Continuation-in-part of Ser. No. 19,132, Feb. 18, 1993, abandoned.

[51] Int. Cl.[6] ..... H01Q 1/24

[52] U.S. Cl. ..... 343/702; 343/841; 455/89; 455/90

[58] Field of Search ..... 343/702, 841, 343/846, 848, 829, 830, 790, 791, 767, 872; 455/117, 129, 89, 90; H01Q 1/24, 1/20, 1/50, 1/52

[56] References Cited

U.S. PATENT DOCUMENTS

| | | | |
|---|---|---|---|
| 2,026,652 | 1/1936 | Ponte | 343/848 |
| 2,082,820 | 6/1937 | Bouvier et al. | 343/841 |
| 2,425,585 | 8/1947 | Wheeler | 343/841 |
| 4,342,037 | 7/1982 | Dalby | 343/846 |
| 5,267,297 | 11/1993 | Kawano et al. | 343/702 |
| 5,335,366 | 8/1994 | Daniels | 343/702 |

*Primary Examiner*—Hoanganh Le
*Attorney, Agent, or Firm*—Foley & Lardner

[57] ABSTRACT

A shield for selectively preventing the propagation of electromagnetic radiation away from an antenna in the direction of the human operator for a cellular telephone and a transmitter, receiver or transceiver, the shield being formed of electrically conductive electromagnetic shield material applied to or embedded in the nonconductive insulating material encapsulating the antenna or to a nonconductive structure for the antenna and located in the area of the antenna which is in close proximity to the operator.

10 Claims, 6 Drawing Sheets

RADIATION SHIELD

RELATED APPLICATION

This application is a continuation-in-part of U.S. patent application Ser. No. 08/019,132, filed Feb. 18, 1993, entitled "SELECTIVELY PERMEABLE ELECTROMAGNETIC RADIATION SHIELD FOR CELLULAR TELEPHONES," now abandoned.

FIELD OF THE INVENTION

The present invention is concerned generally with a selective electromagnetic radiation shield for transmitters, receivers or transceivers. More particularly this invention is concerned with an electromagnetic radiation shield for cellular telephones and other transmitters, receivers and transceivers, which selectively and partially shields nearby human body cells from electromagnetic radiation by disrupting its flow, acts as an antenna signal ground plane and concentrates the antenna signal while permitting the transmission and/or reception of radio frequency waves or energy to or from open space.

BACKGROUND OF THE INVENTION

The uncertainty surrounding the effect of electromagnetic radiation on human cells has created considerable debate in the scientific and governmental regulatory community. The study of human cells in close proximity to electromagnetic radiation involves complicated and expensive procedures which can take many years to complete with conclusive results. Growth in the use of cellular telephones in recent years has been explosive, with approximately 10,000,000 users in the United States and the addition of 7,000 new users daily. The cellular telephones are an ever-increasing percentage of the growth in the industry which supports and supplies cellular telephones. The need exists to provide personal communicator, two way radio and cellular telephone users and manufacturers with a simple and cost effective means of shielding or partially shielding human cells in close proximity to transmitters, receivers, antennas and other components which radiate electromagnetic energy and waves, without disrupting the function and performance of such communication devices. The use of electromagnetic radiation shielding is commonplace in the electronics industry. Typically such shields completely surround, isolate or encase radiating components or passive components sensitive to electromagnetic effects. In this particular application, transmitting and receiving devices such as cellular telephones, the encasement or blocking of the active, electromagnetic radiating elements destroys the intended functions of transmitting and receiving radio frequency waves. Alternatively, the encapsulation of nearby human cells does not seem practical.

SUMMARY OF THE PRESENT INVENTION

The object of this invention is to selectively shield electromagnetic radiation from human cells by selectively placing electromagnetic shields between the electromagnetic radiating components of the transmitter, receiver or transceiver, to disrupt the passage of electromagnetic radiation, yet not obstruct the electromagnetic signals to or from open space. This can be accomplished by several techniques and designs with the essential common principle of permitting the electromagnetic radiation to flow into open space in a physical direction away from human cells. The direction of electromagnetic radiation into open space permits the normal and intended function of the receiver-transmitter, antennas and other possible radiating components. Conversely the electromagnetic radiation exposure of nearby human cells is substantially reduced by disrupting and diffusing the flow of electromagnetic radiation in the physical direction of human cells by the selective placement of an electromagnetic radiation shield.

The use of selectively permeable electromagnetic shielding permits the use of higher power or higher wattage transmitters and receivers that increase performance without increasing levels of electromagnetic radiation exposure to nearby human cells. The ability to increase power levels beyond certain levels, however, has limitations due to the heat dissipation problems incurred in the electronic circuitry of the transmitter/receiver as well as the increases in battery size required to provide increased power levels.

The use of a selective electromagnetic radiation shield with a transmitter/receiver not only can be used to reduce electromagnetic radiation, but such shields can significantly enhance the performance of transmitter/receiver antennas without increasing power levels.

This enhanced transmitter/receiver performance is due to several factors inherent in the selectively permeable electromagnetic shield design.

The first factor in the enhanced performance is the design of the selectively permeable electromagnetic shield, which prevents the absorption of the transmitter antenna signals by nearby human cells, which act as an attenuator of the antenna signal strength.

The second factor is that the selectively permeable electromagnetic shield as shown acts as an antenna signal ground plane when the shield assembly is electrically connected to the transmitter/receiver case and/or to the coaxial antenna feed cable shield. In this configuration the selectively permeable electromagnetic shield can enhance the antenna gain from 2 dB to 6 dB. Within certain design limitations, the gain enhancement is directly related to the size of the surface area of the selectively permeable electromagnetic shield. Optimum sizes of a circular shield would be a diameter approximately one-quarter, one-half or one wave length, however, other sizes are functional.

The third factor is that the selectively permeable electromagnetic shield concentrates the antenna signal due to reflection of electromagnetic waves from its surface. This reflected electromagnetic wave pattern can facilitate the omni-directional antenna emission pattern of the transmitter/receiver in a vertical plane. The concentration of the emission pattern in the vertical plane increases the operational performance of the transmitter/receiver, because the base station antenna which communicates with the transmitter/receiver is designed to function with signals in the vertical plane.

It is, therefore, an object of this invention to provide improved methods and articles of manufacture to selectively disrupt, reduce or diffuse the flow of electromagnetic waves by selectively placing electromagnetic radiation shield material on electromagnetic radiating components to protect human cells in close proximity to such components.

It is another object of the invention to provide an electromagnetic radiation shield that will not significantly alter or degrade the performance of radio frequency transmitters, receivers, antennas or components associated with radio frequency communication devices such as cellular telephones.

It is another object of the invention to provide a shield structure with selectively attached and placed conductive materials to shield human cells from electromagnetic radiation.

It is another object of the invention to provide a nonmetallic shield structure which is selectively composed of metallic substances which shield human cells from electromagnetic radiation.

It is another object of the invention to provide a shield structure which does not shield electromagnetic radiation and which is selectively composed of materials to shield electromagnetic radiation from human cells located in close proximity to such radiation.

It is yet another object of the invention to place an electromagnetic shield between the unshielded sections of a radiating antenna to protect nearby human cells from radiation.

It is, therefore, an object of the invention to partially and selectively shield a radiating antenna with an electromagnetic radiation shield in the physical direction and proximity of human cells, providing an unobstructed path for electromagnetic radiation into the direction of open space.

It is a further object of the invention to provide a means of selectively electromagnetically shielding existing transmitting and receiving communications devices without the necessity of retrofitting or remanufacturing such devices by providing a selectively shielded enclosure case.

It is a further object of the invention to provide for the design and manufacture of new antenna and electromagnetic radiation components for transmitting and receiving communication devices, so that selective electromagnetic radiation shielding can be incorporated at the time of original manufacture to provide electromagnetic radiation shielding in the physical direction of nearby human cells yet provide for the unobstructed passage of electromagnetic waves into open space.

It is a further object of the invention to provide an electromagnetic shield structure which enhances the performance of a transmitter/receiver without an increase in power levels.

Other principal features and advantages of the invention will become apparent to those skilled in the art upon review of the following drawings, the detailed description and the appended claims.

Figure 1:
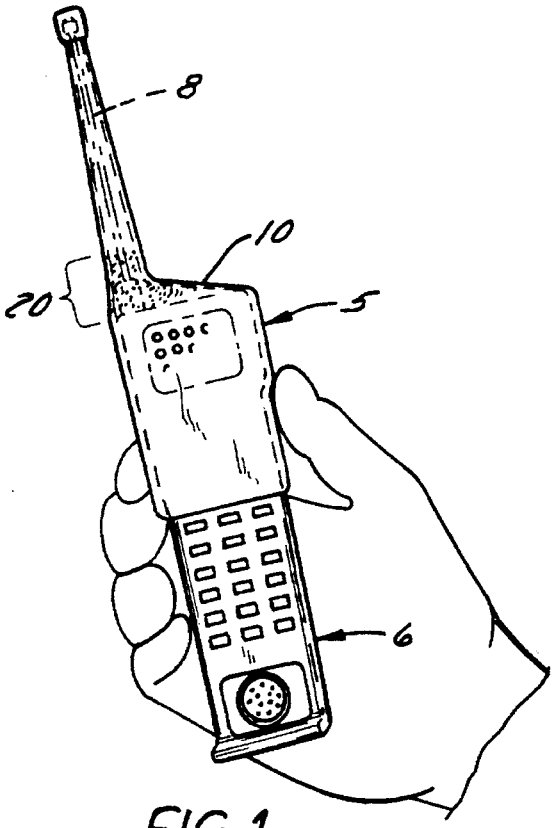
FIG. 1 is a front elevation view of a transmitter, receiver or transceiver encased by a slip-on cover having an electromagnetic radiation shield selectively located on or in the cover.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 2:
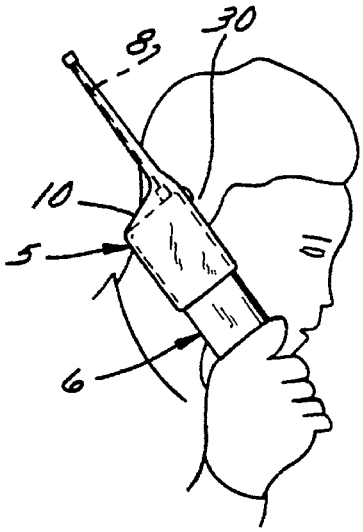
FIG. 2 is a back elevation view of FIG. 1.
Figure 3:
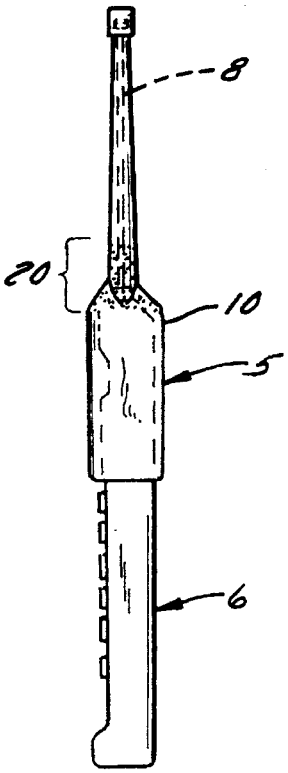
FIG. 3 is a side elevation view of FIG. 1.
Figure 4:
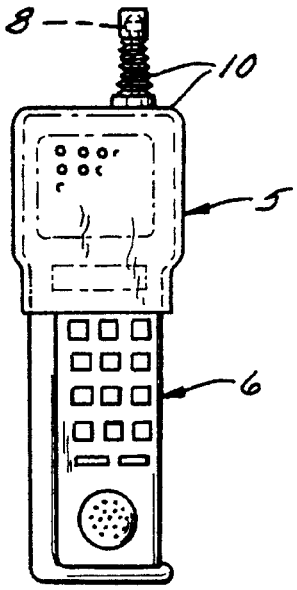
FIG. 4 is a view similar to FIG. 1 with the antenna collapsed.

Referring to the drawings and in particular to FIGS. 1, 2 and 3, an electromagnetic shield 5 constructed in accordance with the invention is shown mounted on a cellular telephone 6 having an antenna 8. Selective electromagnetic radiation shielding is accomplished by utilizing a nonmetallic cover 10 of plastic or leather having an electromagnetic radiation shield 20 formed in a selective area of the cover 10. The shield 20 can be formed of any of a number of materials which exhibit electromagnetic radiation shielding characteristic as noted hereinafter. The shield 20 is selectively incorporated or placed in a part of cover 10 to shield the human cells 30 located in close proximity to the source of electromagnetic radiation. The major portion of the cover 10 permits the unobstructed passage of electromagnetic radiation through cover 10. In this embodiment, the cover 10 is made of leather with particles of aluminum or copper 20 embedded in the leather. The cover 10 can be collapsed when the antenna is telescoped into the transmitter, receiver or transceiver as shown in FIG. 4.

It has been determined previously that numerous materials exhibit electromagnetic radiation shielding characteristics. Materials having a relative conductivity above 0.5 such as silver, copper, gold, chromium and aluminum can be used for the shield as shown in Appendix B of TECKNIT *EMI Shielding Design Guide* (129 Dermody Street, Cranford, N.J. 07016). These materials can be in the form of a powder, wire mesh or perforated panel mounted on or in the cover material. The most commonly available materials are aluminum and annealed copper. Table IA below shows the relative power levels for unshielded antennas. The material selected for the data collected in Table IB below was copper sheet. In each table, relative electromagnetic radiation power levels were measured parallel to the front face of a Motorola Ultra Classic Cellular Telephone, using a Holaday Model HI-3001 Broad Band Exposure Meter.

TABLE IA

| Motorola Ultra Classic No Shielding | |
|---|---|
| Inches From Ultra Classic | Relative Electromagnetic Radiation Power Level |
| 1.0" | 0.59 mW/cm$^2$ |
| 3.0" | 0.13 mW/cm$^2$ |
| 6.0" | 0.04 mW/cm$^2$ |

TABLE IB

| Motorola Ultra Classic With Selectivity Permeable Electromagnetic Radiation Shield | |
|---|---|
| Inches From Motorola Ultra Classic | Relative Electromagnetic Radiation Power Level |
| Surface 0.0" | 0.053 mW/cm$^2$ |

Figure 5:
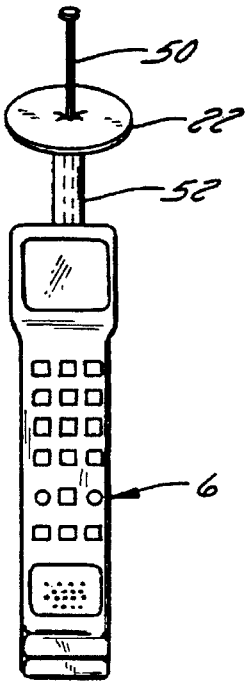
FIG. 5 is a front view of a transmitter, receiver or transceiver having an electromagnetic radiation shield in the form of a disc located between a shielded cable and the antenna.
Figure 6:
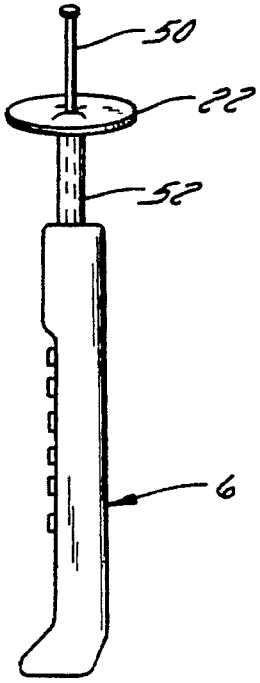
FIG. 6 is a side elevation view of FIG. 4.

An alternate form of an electromagnetic radiation shield 22 can be constructed as shown in FIGS. 5 and 6 by the placement of an electromagnetic radiation shield 22 in the form of a miniature aluminum umbrella or disc between the unshielded sections of the radiating antenna 50 and the shielded cable 52 of the transmitting and/or receiving device. The shield 22 serves to obstruct the electromagnetic radiation in the direction of an operator, yet allows the unobstructed flow of electromagnetic radiation into space. The antenna 50 and the umbrella shaped shield 22 can be collapsed into a tubular member when not in use.

Figure 7:
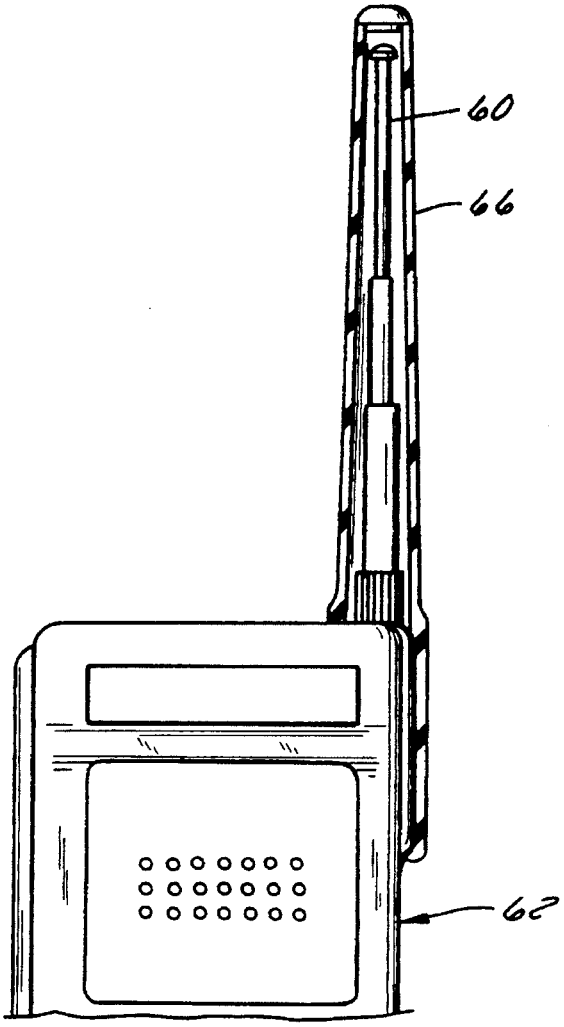
FIG. 7 is a front elevation view of another embodiment of the invention having a selectively shielded antenna.
Figure 8:
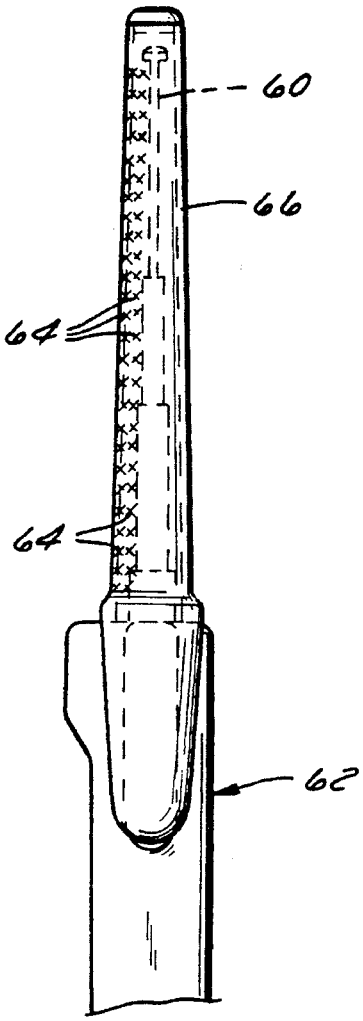
FIG. 8 is a side elevation view of the invention shown in FIG. 7.

The antenna 60 shown in FIGS. 7 and 8 is telescoped into a transmitter, receiver or transceiver 62. The antenna is selectively shielded by applying, embedding or coating the nonconductive insulation 66 on the antenna 60 with an electromagnetic radiation shield 64. In this regard the radiation shield 64 can be painted on the outside of the insulation material 66 on the antenna on the side of the antenna adjacent the operator. A conductive paint loaded with very fine particles of a conductive material such as silver, gold or carbon can be used to form the electromagnetic shield coating 66. The percentage loading of conductive material in the paint should be from 20% to 80% by weight to provide moderate to very high conductivity.

Figure 9:
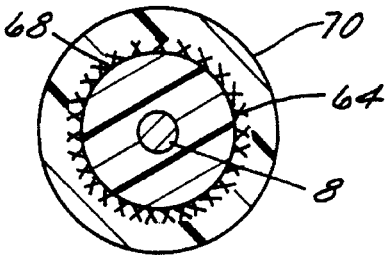
FIG. 9 is a cross section view of an antenna showing the wire mesh embedded in the antenna insulation.

Another alternative material is a wire mesh formed from the above listed materials. The mesh must have good contact at the intersections of the mesh material. The mesh can be placed on the nonconductive surface covering the antenna or embedded in the exterior surface of the nonconductive material on the antenna as shown in FIG. 9. With this arrangement electromagnetic radiation can be effectively shielded from the operator.

Figure 10:
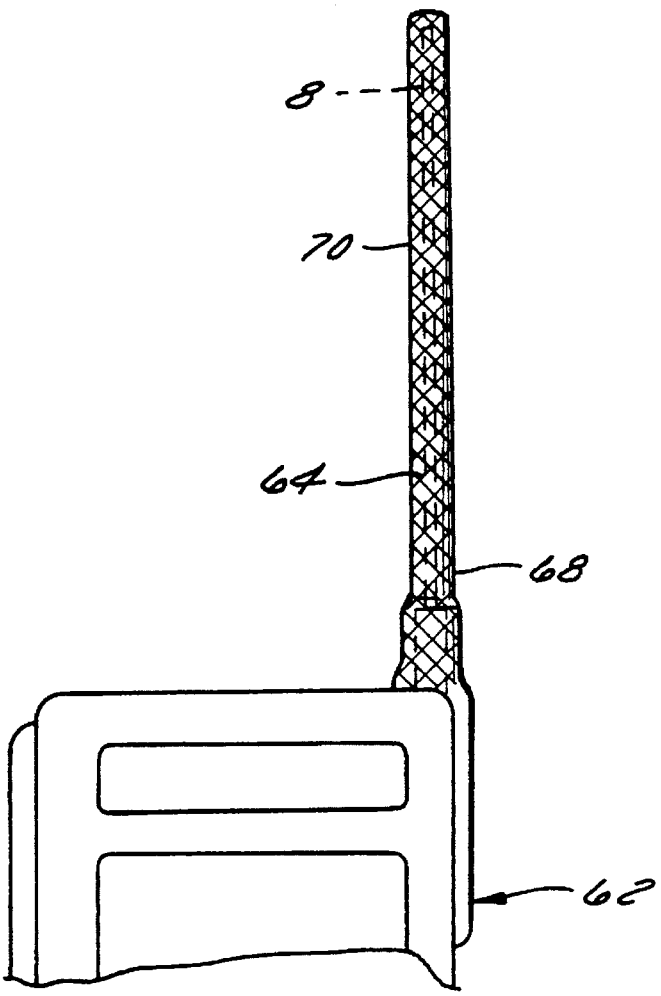
FIG. 10 is a first elevation view of an alternate form of a radiation shield for an antenna.
Figure 11:
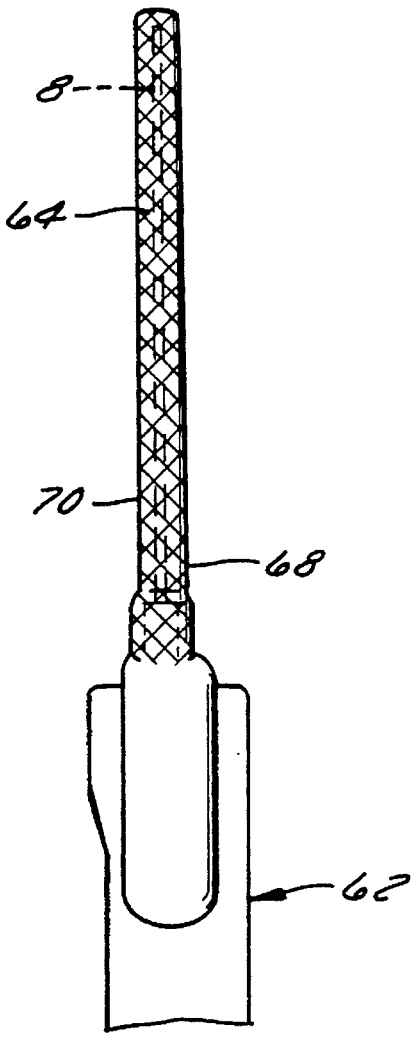
FIG. 11 is a side elevation view of FIG. 10.

Another form of electromagnetic radiation shield 64 can be constructed as shown in FIGS. 10 and 11 by the construction of a transmitting or receiving antenna which is covered with a plastic or similar nonconductive material 68. An additional electromagnetic radiation shield 64 is selectively placed over the nonconductive material 68 encasing the antenna element 8. The electromagnetic shield material 64 is encased in an insulating sleeve 10. The shield 64 is selectively placed to obstruct electromagnetic radiation in the direction of the operator, but permits the flow of electromagnetic radiation into space. This entire assembly can be constructed to remain in a fixed position or to retract into the transceiver case.

Selective electromagnetic radiation shields can be fitted to previously manufactured transmitters, receivers or transceivers or such shields can be designed and incorporated in new devices containing electromagnetic radiating elements such as antenna, transmitter or receiver electronics. New antenna designs and shapes can be made to minimize loss of radio frequency signals to or from open space as a result of selective electromagnetic radiation shielding.

Figure 12:
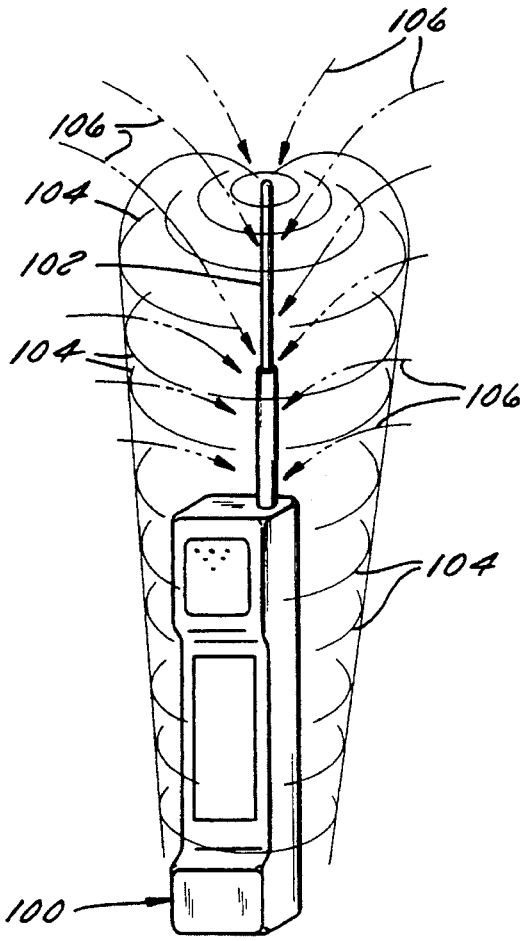
FIG. 12 is a perspective view of a cellular telephone having an unshielded antenna showing the electromagnetic field pattern around the antenna.
Figure 14:
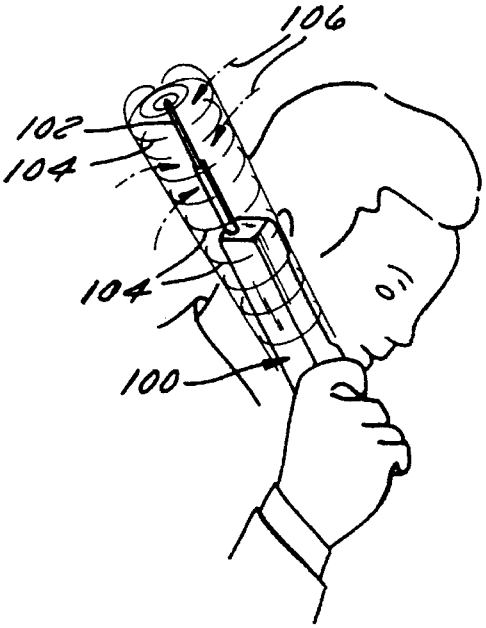
FIG. 14 is a view similar to FIG. 2 showing the electromagnetic field around an unshielded cellular telephone antenna.
Figure 15:
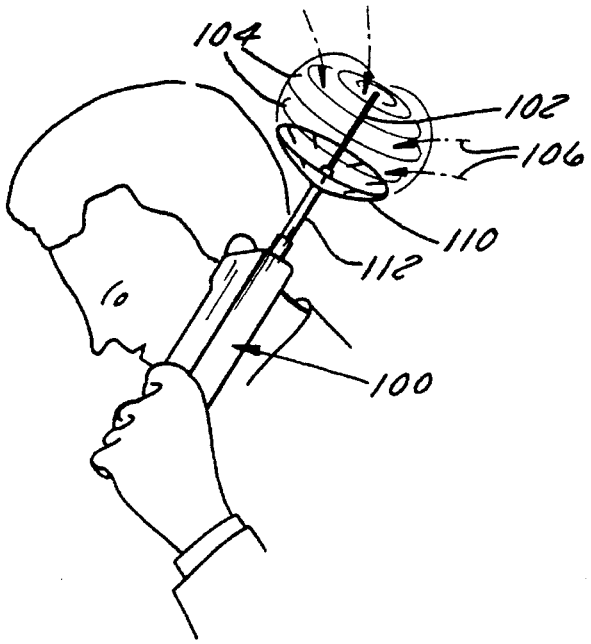
FIG. 15 is a view similar to FIG. 14 showing a dish mounted on the antenna with the electromagnetic field shielded by the dish.

Referring to FIGS. 12 and 14 a typical cellular telephone is shown, having an antenna 102 extending upwardly from the telephone. Typically the magnetic field around the conductor is shown by solid lines 104 which are circles concentric with the conductor and surround both the conductor and the telephone. The electric field, as shown by dashed lines 106, around the antenna is similar to an electric dipole and the combined electric and magnetic fields are like that which would result if the electric moment of the dipole alternated sinusoidally in magnitude. What is represented therefore is a wave form where the electric and magnetic lines are close together the fields are strong and where they are far apart the fields are weak. It should be noted that the intensity of the electromagnetic field is greatest at the juncture of the antenna with the cellular telephone. When the telephone is held by the operator, shown in FIG. 14, the intense field is in close proximity to the human cells of the operator which absorb the radiation. The absorption of radiation by human cells attenuates the antenna signal causing a decrease in transmitter/receiver performance.

Referring to FIGS. 5 and 6 and 13 and 15 the cellular telephones 6 and 100 are shown with a shield such as a disc 22 or dish 110 mounted on the antenna in a spaced relation to the cellular telephone. The portion of the antenna between the cellular telephone and the disc 22 and dish 110 is shielded at 52 and 112, respectively. In this embodiment shown in FIGS. 13 and 15 it should be noted that the electromagnetic field around the antenna is located above the dish, thus preventing exposure of the operator to the electromagnetic field.

Further, the location of the electromagnetic field above the disc 22 or dish 110 prevents the absorption of electromagnetic radiation by the human cells of the operator.

When the disc 22 and dish 110 are conductively connected to the coaxial antenna feed cable ground shield or to the antenna assembly signal ground shield, the electromagnetic shield disc 22 and dish 110 secondarily functions as a ground plane for the antenna. This secondary function increases the antenna gain, by providing a more effective antenna signal ground plane.

Figure 13:
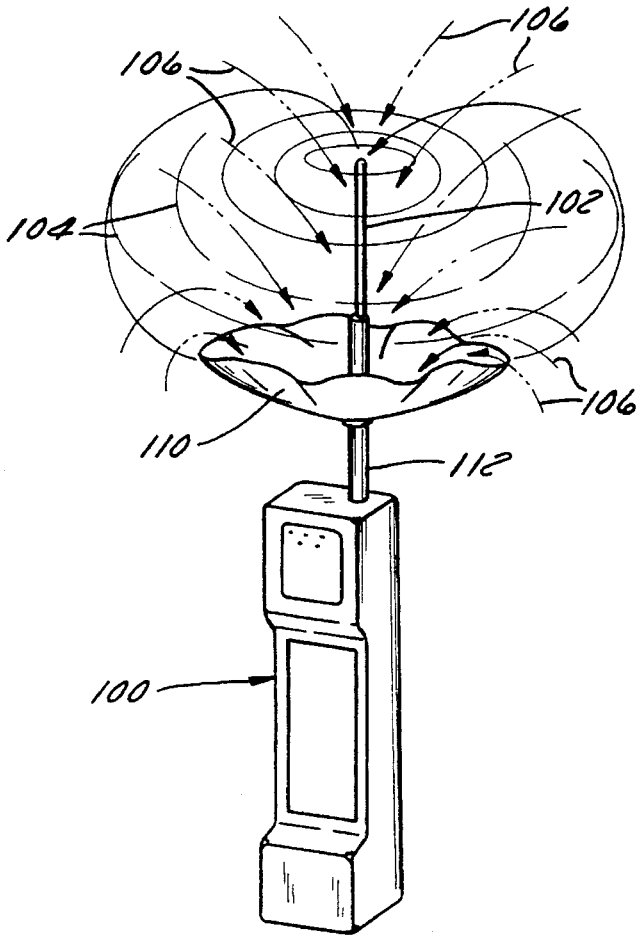
FIG. 13 is a perspective view of a cellular telephone and its electromagnetic field or antenna pattern having an electromagnetic radiation shield in the form of a dish.

The resulting antenna signal pattern caused by shield dish 110 as shown in FIG. 13 creates a concentrated signal pattern due to the uniform reflection of electromagnetic waves from its surface. The concentrated signal pattern in FIG. 13 increases the operational performance of the transmitter/receiver. The performance of the antenna signal pattern 106 shown in FIG. 12, without a shield dish 110, is less concentrated and is not as effective due to the electromagnetic wave currents 104 which flow downward and over the cellular telephone in a less concentrated manner, because the cellular telephone case acts as the antenna ground plane. Although a circular dish 110 is shown in the drawing various configurations can be used with the same effect such as square, octagonal, rectangular and spherical.

Figure 16A:
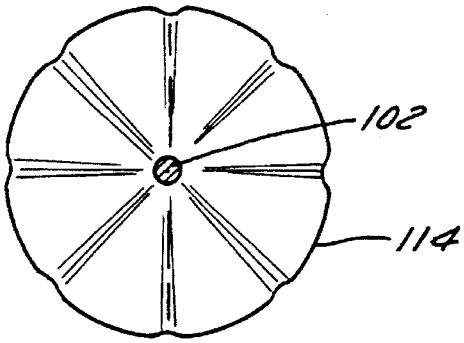
FIG. 16A is a top view of FIG. 16 showing the configuration of the dish.
Figure 16:
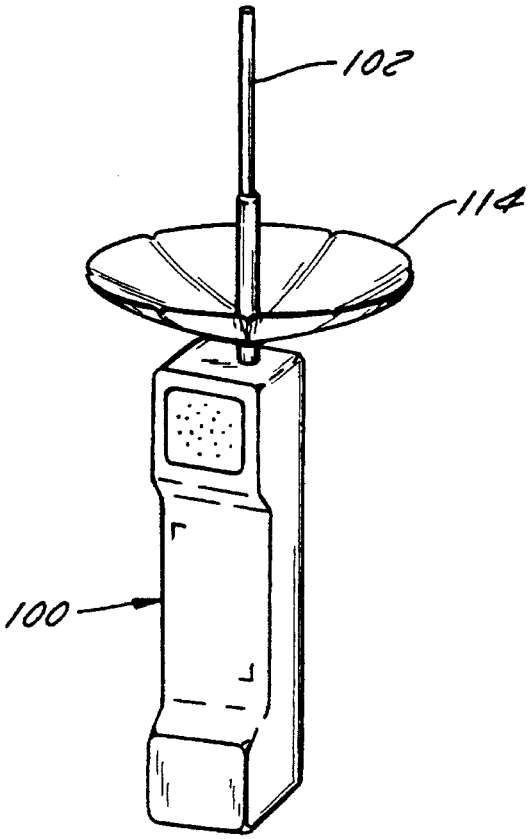
FIG. 16 is a perspective view of the antenna with a collapsible disc mounted thereon.
Figure 17:
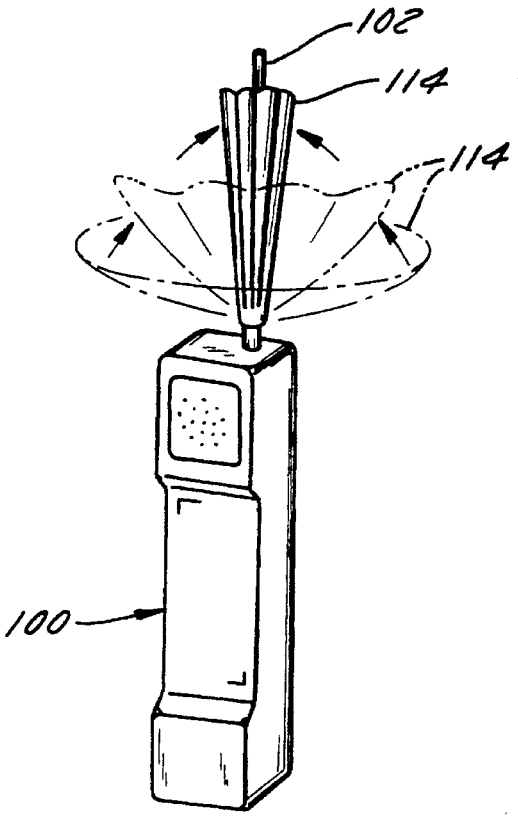
FIG. 17 is a perspective view of the cellular telephone and shield of FIG. 16 with the dish collapsed on the antenna.

Referring to FIGS. 16, 16A and 17 the cellular telephone 100 is shown with a conductive structure such as collapsible dish 114 mounted on the antenna 102. The collapsible dish is shown collapsed on the antenna for storage in FIG. 17.

The radiation shield as described herein is shown mounted on a radio frequency communication device such as a cellular telephone, satellite telephone, two-way radio, transceiver, and the like.

Thus, it should be apparent that there has been provided in accordance with the present invention a radiation shield that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A radiation shielding apparatus in combination with a cellular telephone radio transmitting device having a radiation emanating external antenna for transmission of electromagnetic radiation, said radiation shielding apparatus comprising a disc which shields the user from radiation emanating from the antenna toward the user and means for maintaining the disc at an operable position between the antenna and the user of the cellular telephone device so that at the operable position the disc is effective to prevent exposure of the user to the radiation during all transmission of electromagnetic radiation from the radiation emanating antenna.

2. The apparatus according to claim 1 wherein said disc is formed from a material selected from a group consisting of copper, chromium, aluminum, brass and magnesium.

3. The apparatus according to claim 1 wherein said electromagnetic radiation shielding material has a relative conductivity greater than 0.5.

4. The apparatus according to claim 1 wherein said disc functions as a radio antenna signal ground plane.

5. The apparatus according to claim 1 wherein said disc increases the effectiveness of the radio frequency signal transmission and/or reception of said antenna assembly.

6. The apparatus according to claim 1 wherein said disc is attached to one of a cellular telephone, satellite telephone, two-way radio, transceiver or portable radio frequency communications device.

7. A radiation shielding apparatus for use with an antenna for transmitting and/or receiving radio frequency signals and, for selectively directing the flow of antenna radiation away from the user, said apparatus comprising:

a ground shield attached to the antenna which shields the user from radiation emanating from the antenna, said ground shield is in the form of a disc which permits the unobstructed flow of radio frequency antenna signals from said disc in the general direction of open space.

8. The apparatus according to claim 7 wherein said disc is attached to one of a cellular telephone, satellite telephone, two-way radio, transceiver or portable radio frequency communications device.

9. The apparatus according to claim 7 wherein said disc increases the effectiveness of the radio frequency signal transmission and/or reception of said antenna.

10. The apparatus according to claim 7 wherein said disc is formed from a material selected from the group consisting of copper, chromium, aluminum, brass and magnesium.

* * * * *